US007281906B2

(12) United States Patent
Tanikawa et al.

(10) Patent No.: US 7,281,906 B2
(45) Date of Patent: Oct. 16, 2007

(54) OIL PUMP FOR AUTOMATIC TRANSMISSION

(75) Inventors: Naoya Tanikawa, Nagoya (JP); Takanao Suzuki, Nothville, MI (US); Shinichi Takita, Okazaki (JP)

(73) Assignees: Aisin Seiki Kabushiki Kaisha, Kariya-Shi, Aichi-Ken (JP); Toyooki Kogyo Co., Ltd., Okazaki-Shi, Aichi-Ken (JP)

( * ) Notice: Subject to any disclaimer, the term of this patent is extended or adjusted under 35 U.S.C. 154(b) by 619 days.

(21) Appl. No.: 10/669,439

(22) Filed: Sep. 25, 2003

(65) Prior Publication Data

US 2004/0213688 A1 Oct. 28, 2004

(30) Foreign Application Priority Data

Sep. 25, 2002 (JP) ..... 2002-279237

(51) Int. Cl.
*F04B 49/035* (2006.01)

(52) U.S. Cl. ..... 417/310

(58) Field of Classification Search ..... 417/310, 417/440; 418/171; 475/159
See application file for complete search history.

(56) References Cited

U.S. PATENT DOCUMENTS 4,255,093 A * 3/1981 Erikson ..... 417/310
5,014,741 A * 5/1991 Taguchi ..... 184/6.12
5,722,815 A * 3/1998 Cozens ..... 417/310
5,738,501 A * 4/1998 Eisenmann ..... 417/310
5,759,013 A * 6/1998 Miyazaki et al. ..... 417/310
5,797,732 A * 8/1998 Watanabe et al. ..... 417/310
6,113,360 A * 9/2000 Yu et al. ..... 417/310
6,168,391 B1 * 1/2001 Ono ..... 417/310
6,386,836 B1 * 5/2002 Johnson ..... 417/310
6,817,843 B2 * 11/2004 Leising et al. ..... 417/310

* cited by examiner

*Primary Examiner*—Michael Koczo, Jr.
(74) *Attorney, Agent, or Firm*—Buchanan Ingersoll & Rooney PC

(57) ABSTRACT

An oil pump for an automatic transmission includes a pump body having a pump chamber, a pump cover disposed so as to oppose to the pump body, an inner rotor disposed in the pump chamber and driven by a driving force from a torque converter and an outer rotor meshed with the inner rotor. The pump body includes a pump suction port, a pump discharge port a first oil, passage for supplying oil from a oil pan to the pump suction port, a second oil passage for returning excess oil of a first regulator to the first oil passage and a third oil passage having an outlet port for returning excess oil of a second regulator to the pump suction port.

2 Claims, 4 Drawing Sheets

OIL PUMP FOR AUTOMATIC TRANSMISSION

CROSS REFERENCE TO RELATED APPLICATIONS

This application is based on and claims priority to Japanese Patent Application No. 2002-279237 filed on Sep. 25, 2002, the entire content of which is incorporated herein by reference.

FIELD OF THE INVENTION

The present invention relates to an oil pump for an automatic transmission.

BACKGROUND OF THE INVENTION

An oil pump for an automatic transmission includes a drive gear driven by a pump drive hub which is connected to a pump impeller of a torque converter and which is rotatably supported on a pump body through a bush, and a driven gear which is disposed so as to mesh with the drive gear and whose axial center is eccentric with respect to the axial center of the drive gear. These gears are disposed between a pump body fixed to a case of the transmission and a side surface of a pump cover fixed to the pump body. These gears are rotated in a space (pump chamber) defined between the pump cover and a pump plate fixed to the pump body by the pump drive hub and supply low-pressure oil (for example, −0.1 MPa) from a suction port to various parts as high pressure oil (for example, 1.8 MPa).

On mating faces between the pump body and the pump plate and between the pump plate and the pump cover, many oil passages which communicate to a discharge port and which supply the oil from an oil pan to the suction port are formed. Many oil passages which communicate to clutches, brakes or various types of valyes are formed intricately on the pump body, the pump cover and the pump plate.

In the automatic transmission, it is necessary to control hydraulic pressure in the oil passages finely and exactly in order to reduce shift shock. It is desirable to increase the diameter of the oil passages communicated to the clutches, the brakes and the valyes and to shorten of the length thereof. However, it is not able to adopt this measure in restricted space. In some cases, fine and long oil passages are adopted and thereby the delay in response or hydraulic pressure vibration are caused.

In order to avoid the delay in response or the hydraulic pressure vibration, it is desired that the oil passage from a control valye to the clutches, the brakes and the valyes is shortened and that the diameter of the oil passage in a valye body is increased. Therefore, a first regulator and a second regulator (pressure control mechanism) are provided on the oil pump and the diameter of the oil passage in a valye body is increased. Further, the control valye is disposed at a position where the regulator is disposed and the oil passages from the clutches, the brakes and the valyes to the control valye is shortened.

When the oil pump is driven at high speed, excess oil by the regulators is returned to an oil port formed on the oil pump and communicated to the oil pan. This structure is disclosed, for example, in "PRINCIPLES OF OPERATION" 1000/2000/2400 Series on highway transmission "P03065EN", (USA), General Motors Corp., March 1999, foldout 15-16. Referring to FIG. 4, this structure is described as follows.

FIG. 4 shows a side face of a pump body 101 of prior oil pump. The pump body 101 includes an oil port 102 communicated to the oil pan, a first oil passage 103, an oil suction port 104, an oil discharge port 105 which supplies the pressurized oil in the oil chamber to various parts, a second oil passage 106 which is communicated to the first regulator and which returns the excess oil to the first oil passage 103 and a third oil passage 107 which is communicated to the second regulator and which returns the excess oil to the first oil passage 103. The numeral 108 shows the pump drive hub and the numeral 109 shows an oil recover passage.

The oil from the oil pan flows into the first oil passage 103 along a flow shown by A and the oil in the second oil passage 106 from the first regulator flows into the first oil passage 103 along a flow shown by B. Further, the oil in the third oil passage 107 from the second regulator flows into the first oil passage 103 along a flow shown by C. Namely, the excess oil from the regulators is not returned to the oil pan directly and is merged to the oil flow A.

In FIG. 4, the oil flow A heads toward the first oil passage 103. The oil flows B and C include downward components and ram the oil flow A from the side. Thereby, turbulent flow generates by three oil flows A, B and C and the limit of the cavitation is decreased. As a result, abnormal noise is generated at high speed rotation of the oil pump.

SUMMARY OF THE INVENTION

It is, therefore, an object of the present invention to overcome the above drawback.

In order to achieve the foregoing object, the present invention provides an oil pump for automatic transmission which includes a pump body having a pump chamber, a pump cover disposed so as to oppose to the pump body, an inner rotor disposed In the pump chamber and driven by a driving force from a torque converter and an outer rotor meshed with the inner rotor, wherein the pump body includes a pump suction port, a pump discharge port, a first oil passage for supplying oil from a oil pan to the pump suction port, a second oil passage for returning excess oil of a first regulator to the first oil passage and a third oil passage having an outlet port for returning excess oil of a second regulator to the pump suction port.

BRIEF DESCRIPTION OF THE DRAWINGS

The above and other objects, features and advantages of the present invention will be more apparent and more readily appreciated from the following detailed description of a preferred exemplary embodiment of the present, invention, taken in connection with the accompanying drawings, in which.

DETAILED DESCRIPTION OF THE PRESENT INVENTION

Figure 3:
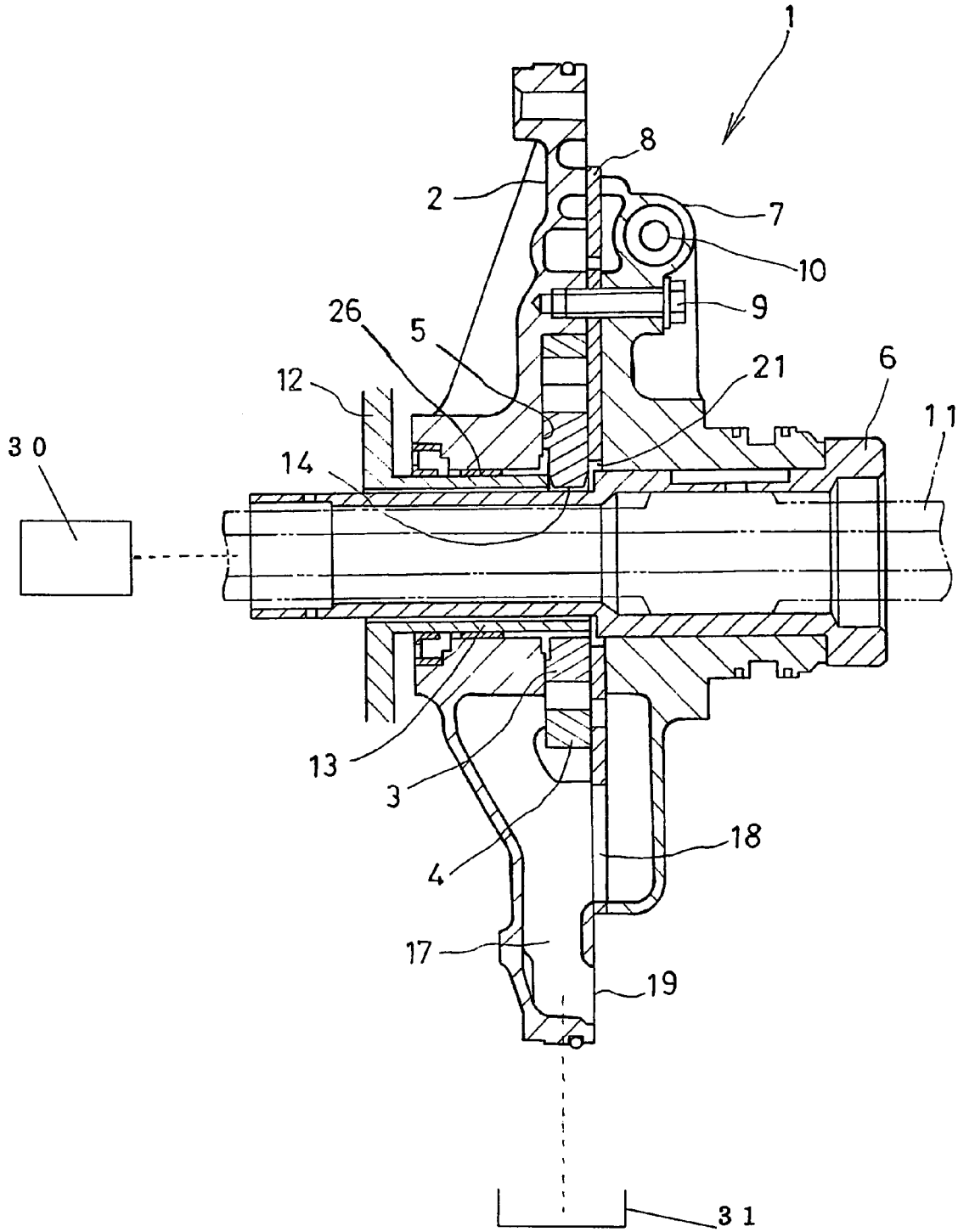
FIG. 3 shows a cross sectional view of an embodiment of an oil pump in accordance with the present invention.
Figure 4:
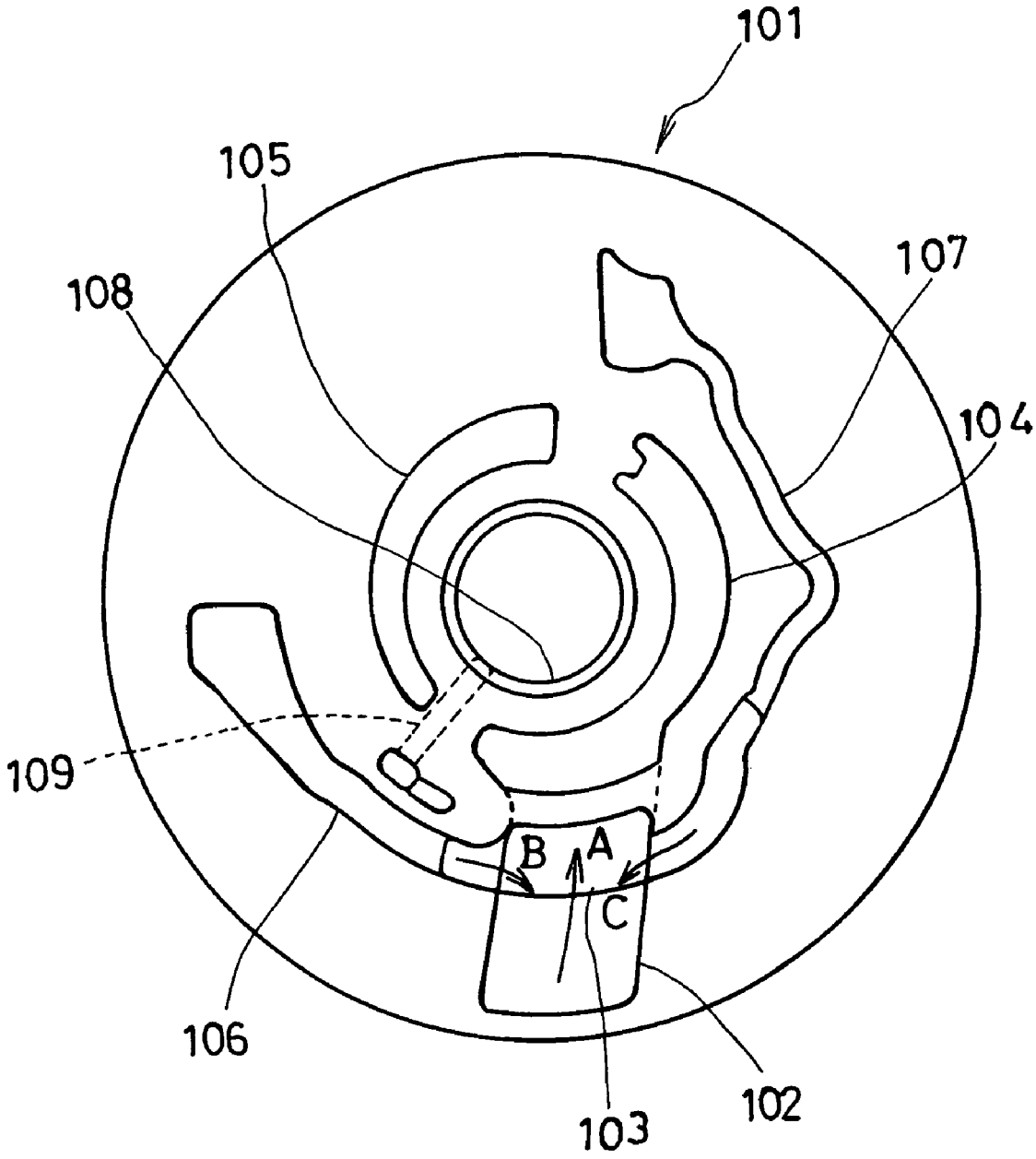
FIG.4 (PRIOR ART)
FIG. 4 shows a front view a pump body of a prior oil pump.

Referring to FIG. 3, an oil pump for an automatic transmission 1 includes a drive gear (inner rotor) 3 which is disposed in a pump chamber 5 formed at a side surface of a pump body 2 and a driven gear (outer rotor) 4 which is disposed so as to mesh with the drive gear 3 and whose axial center is eccentric with respect to the axial center of the drive gear 3. The number of teeth of the driven gear 4 is not the same as that of the drive gear 3.

The pump chamber 5 is defined by a pump plate 8 which is disposed on a side surface of a pump cover 7. A stator shaft 6 is pressed into the Inner circumference of the pump cover 7. The pump cover 7 is fixed to the pump body 2 with the pump plate 8 by a bolt 9.

On mating faces between the pump body 2 and the pump plate 8 and between the pump plate 8 and the pump cover 7, many oil passages are formed in the usual manner. These oil passages are communicated to clutches, brakes and various types of valyes. The numeral 10 shows a pressure regulator valye which is supported on the pump cover 7. In the stator shaft 6, an output shaft 11 from a torque converter 30 is rotatably disposed.

The drive gear 3 is connected to a pump drive hub 12 which is connected to a pump impeller of the torque converter 30. A cylindrical portion 13 of the pump drive hub 12 extends between a boss portion of the pump body 2 and the stator shaft 6 and is supported by a bush 26 which is disposed on the inner circumference of the pump body 2. A top end of the cylindrical portion 13 is engaged with a projection of the inner circumference of the drive gear 3. Thereby, the rotation of the pump drive hub 12 is transmitted to the drive gear 3 directly and the drive gear 3 is rotated with the pump drive hub 12.

The rotation of the drive gear 3 rotates the driven gear 4 and oil filled between the gears 3, 4 is pressurized by the difference of the number of rotation between the gears 3, 4. The oil supplied from a suction port 15 into the pump chamber 5 is pressurized and is discharged from a discharge port to outside. The suction port 15 communicates to a first oil passage 17 defined by the pump body 2 and the pump cover 7 and the first oil passage 17 is communicated to an oil pan 31.

Figure 1:
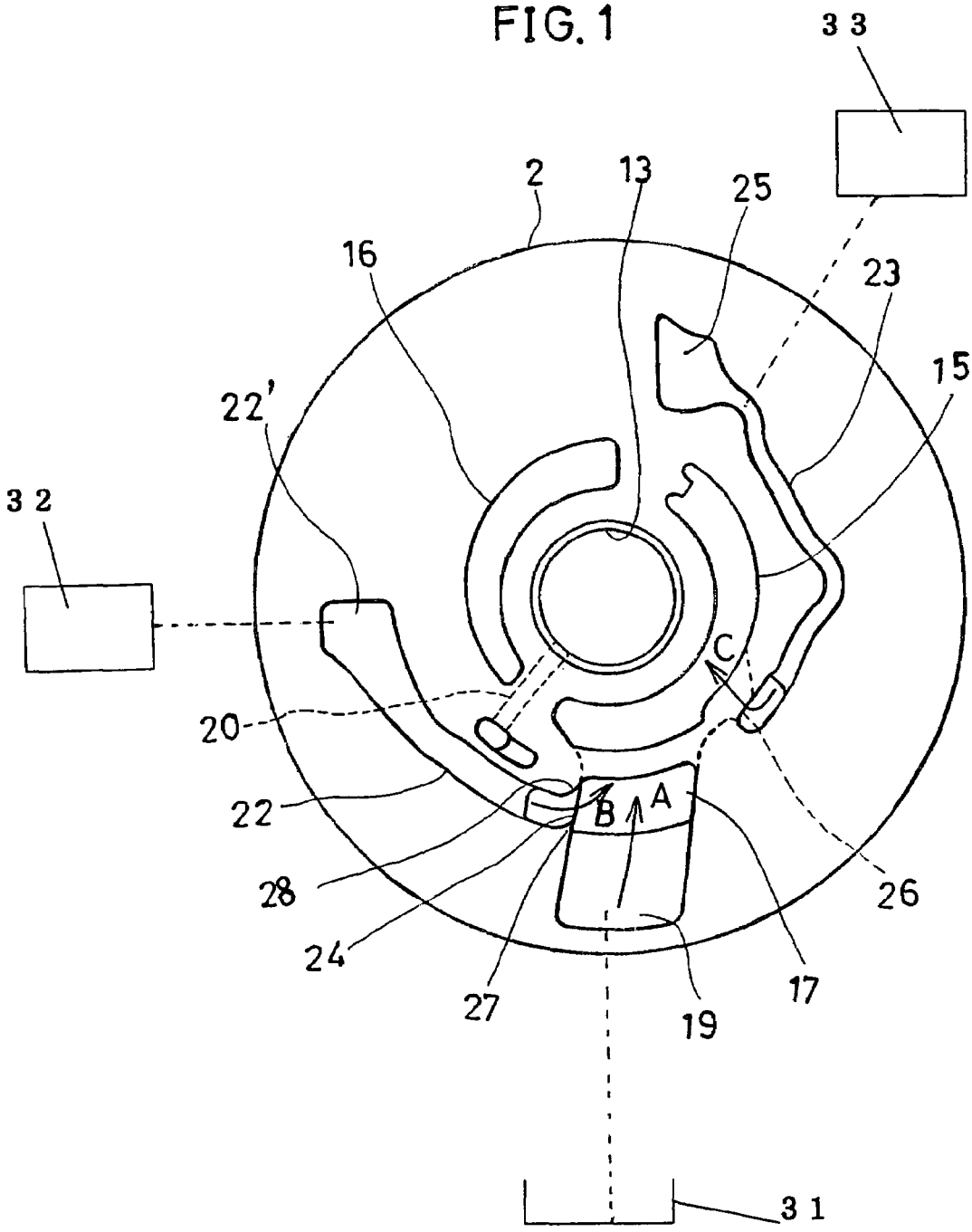
FIG. 1 shows a front view of a pump body of an embodiment of an oil pump in accordance with the present invention.
Figure 2:
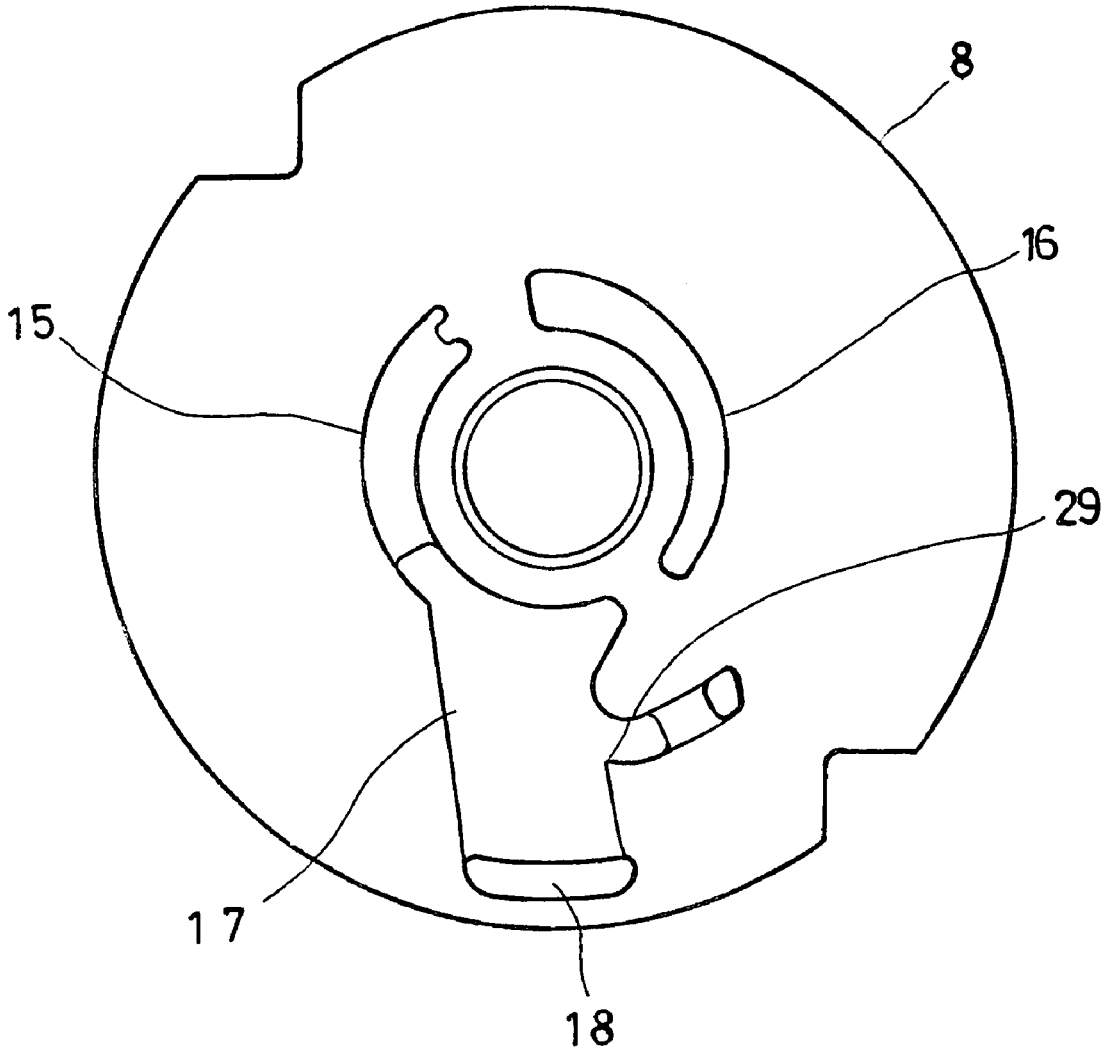
FIG. 2 shows a front view of a pump plate of an embodiment of an oil pump in accordance with the present invention.

In FIG. 1, the suction port 15 and the discharge port 16 which are formed on the pump body 2 are shown. An opening portion 19 is communicated to the oil pan 31. In FIG. 2, the suction port 15 and the discharge port 16 which are formed on the pump plate 8 are shown. An opening portion 18 is communicated to the first oil passage 17.

In FIG. 1, second and third oil passages 22, 23 which are connected to regulators 32, 33 provided on the pump body 2 are shown. The second oil passage 22 includes an opening 22' communicating to the first regulator 32 at its one end. The second oil passage 22 includes an outlet 24 opened into the first oil passage 17 at it's the other end. The second oil passage 22 returns the excess oil from the first regulator 32 to the first oil passage 17. The third oil passage 23 includes an opening 25 communicating to the second regulator 33 at its one end. The third oil passage 23 includes an outlet 26 opened into the suction port 15 at it's the other end. The third oil passage 23 returns the excess oil from the second regulator 33 to the suction port 15.

The second oil passage 22 has a circular arc shape and communicates to the first oil passage 17. On the outlet 24 of the second oil passage 22, a projecting portion 27 is provided in order to make the oil flow B in the second oil passage 22 follow to the oil flow A in the first oil passage 17. On a part of the outlet 24 which is opposite to the projecting portion 27, a taper surface 28 that broadens toward the end is formed. The projecting portion 27 and the taper portion 28 make the oil flow B follow to the oil flow A and avoid the collision between the oil flows A, B. Thereby, turbulent flow does not generate.

The third oil passage 23 has a circular arc shape so as to surround the suction port 15 from outside and is elongate. The outlet 26 which is communicated to the suction port 15 is formed on the end of the outlet side of the third oil passage 23. The first oil passage 17 is broadened toward the suction port 15. The outlet 26 is communicated to a part of the broadened portion of the first oil passage 17. However, it is able to communicate the outlet 26 to the suction port 15 through an Independent passage.

The direct connection of the outlet 26 to the suction port 15 shortens the third oil passage 23. Thereby, especially, when the oil pump is driven at high speed, enough oil is supplied to the suction port 15 and therefore the limit of cavitation is elevated. Further, according to this oil passage shape, since oil is supplied to the suction port 15 so as not to block the flow of oil in the suction port 15, it is able to further elevate the limit of cavitation.

A projecting portion 29 which is the same as the projecting portion 27 is formed on the pump plate 8. The projecting portions 27, 29 minimalize the collision between the oil flow B from the second oil passage 22 and the oil flow A from the first oil passage 17 and the generation of the turbulent flow is prevented.

As mentioned above, according to the present invention, it is able to elevate the limit of cavitation and therefore it is able to prevent the generation of abnormal noise at high speed rotation of the oil pump.

What is claimed is:

1. An oil pump for an automatic transmission comprising:

a pump body;

a pump cover opposed to the pump body to define a pump chamber between the pump body and the pump cover, the pump chamber communicating with a pump suction port and a pump discharge port;

an inner rotor disposed in the pump chamber and driven by a driving force from a torque converter;

an outer rotor meshed with the inner rotor;

a first oil passage for supplying oil from an oil pan to the pump suction port;

a second oil passage for returning excess oil of a first regulator to the first oil passage;

a third oil passage having an outlet port for returning excess oil of a second regulator to the pump suction port;

wherein the third oil passage has a circular arc shape positioned at an outer side of the pump suction port and surrounding the suction port, the third oil passage terminating at the pump suction port, and wherein a radially inwardly projecting portion is formed inside of an outlet of the second oil passage, and oil flow from the outlet of the second oil passage follows the oil flow in the first oil passage.

2. An oil pump for an automatic transmission as recited in claim 1 further comprising a pump plate disposed between the pump body and the pump cover, and a radially inwardly projecting portion provided on the pump plate opposing the radially inwardly projecting portion of the pump body.

* * * * *